United States Patent [19]

Schreyer et al.

[11] 3,983,643

[45] Oct. 5, 1976

[54] SHOE USABLE FOR WALKING AND ROLLER-SKATING

[76] Inventors: Walter Schreyer, Deitingenstr. 26, 4552 Derendingen; Leo Gumbiller, Lagerweg 8, 4900 Langenthal, both of Switzerland

[22] Filed: May 23, 1975

[21] Appl. No.: 580,290

[30] Foreign Application Priority Data

July 3, 1974 Germany ..... 7422590[U]
Nov. 11, 1974 Switzerland ..... 15133/74

[52] U.S. Cl. ..... 36/115; 36/61
[51] Int. Cl.[2] ..... A43C 15/00; A43B 5/04
[58] Field of Search ..... 36/2.5 R, 61, 67 D, 36/115

[56] References Cited

UNITED STATES PATENTS

| | | | |
|---|---|---|---|
| 3,281,971 | 11/1966 | Weitzner | 36/2.5 R |
| 3,526,976 | 9/1970 | Jacobs | 36/2.5 R |
| 3,793,751 | 2/1974 | Gordos | 36/61 |

*Primary Examiner*—Patrick D. Lawson
*Attorney, Agent, or Firm*—Hoiman & Stern

[57] ABSTRACT

A shoe usable for walking or roller skating is disclosed wherein the roller skating means is contained within the sole of the shoe. The skating means is selectively engageable so that the shoe can be used with little effort for either mode of transportation.

8 Claims, 3 Drawing Figures

SHOE USABLE FOR WALKING AND ROLLER-SKATING

BACKGROUND AND OBJECT OF THE INVENTION

The instant invention concerns a shoe for use as a walking shoe and/or roller skates comprising a sole and a roller mechanism with rollers which selectively are recessed into a cavity in the shoe sole or are downwardly extending from said sole.

Such a shoe will enable its alternate utilization as roller-skates and as a walking shoe. It is known in prior art to attach onto a walking shoe a roller mechanism having roller axles, which are in stationary position, either by means of a binder or by means of screws, whereby the sole of the shoe may be as thin as in a normal walking shoe. The binding or screwing of skates to the shoe is inefficient and impractical when a constant change from walking to rolling or rolling to walking is desired. The instant invention provides a roller and walking shoe of the above-described type which enables a fast switching from rolling to walking, and vice-versa, by means of a suitably constructed and attached roller mechanism. It also combines a special roller-frame with the shoe.

SUMMARY OF THE INVENTION

The instant invention comprises a platform shoe-sole which is provided with a cavity in which is mounted the roller mechanism and wherein the rollers are tiltable into a position whereby they protrude out of the sole or into a position pulled back below the sole-surface.

For the purpose of roller-skating, the rollers, for example four in number, are switched out. For the purpose of walking, the rollers are pulled back into the cavity of the sole and a user again stands on a shoe-sole which is preferably formed of a skid-proof material, for example of rubber. Roller-skating also becomes safer by means of the instant invention. When walking up and down a set of stairs, the roller-skates need no longer be removed from the shoes. The instant inventive shoes are not only suitable for children but also for adults who have to walk extensive distances daily, for example, warehouse employees, hospital employees, those working in schools, large office complexes, airport hangers, etc.

It is possible to provide the roller mechanism with a special activating member. This activating member is simple to operate and will not interfere with walking or skating since it does not extend downward beyond the sole.

In a preferred embodiment, the rollers are retained in their position, protruding from the sole, by means of switches, and are moved back into their cavity position by means of a spring. The changing from walking to rolling and vice-versa is speedily accomplished.

The switch can be a two-position spring-urged step-switch. The rollers are tilted outwards (into rolling position) by lightly tapping the activating member against a fixed object, for example a wall or the step of a staircase. By tapping the activating member or switch head, the rollers are pulled inwards (into walking position) by means of the spring. The step-switch is in principle constructed like those in ball-point pens.

In another embodiment of the instant invention, the spring which pulls the rollers into the walking position, engages a lever which is pivotally arranged. The other end of the lever is pushed against a lock-bolt by means of the spring and glides over the lock-bolt when the rollers are tilted into their rolling position. The lever glides over the lock-bolt until it surrounds the lock-bolt with a mouth-shaped clearance and is thus fixed against a longitudinal displacement, whereby the spring pulls the clearance towards the lock-bolt. The rollers are now placed into the rolling position. The lock-bolt is rotatable by means of an activating member and is provided with a projection piece which, during rotation of the lock-bolt, lifts the lever from the lock-bolt. Thereafter, the rollers are pulled into the walking position through the force of the spring. This embodiment of the instant invention, in which the rollers are manually moved into the rolling position, is extremely robust and does not utilize the two-position step-switch which, in an economical construction, is often very troublesome.

According to the present invention, the two axles, each carrying a pair of rollers, are positively coupled to each other, whereby, due to the fixed connection of the two axles, by activating only one member, all four rollers are positively simultaneously either tilted outwards or pulled inwards. Such a positive connection is present, for example, when each one of the axles carries one lever and the two levers are pivotally connected with each end of a rod.

In a preferred embodiment, the roller mechanism together with the step-switch are fixedly mounted on a U-profile support. The switch- and roller-mechanism is then utilizable as an exchangeable mounting-set and can be used for various shoe-sizes.

The entire mechanism can be mounted into a platform sole comprising either wood or a synthetic material. The activating member and the respective two-step switch is selectively arranged either at the toe- or the heel-end of the shoe. This reversibility is easily obtained when the roller mechanism is constructed as a removable attachment piece. It is also possible to arrange the activating member in the cavity of the sole where it is protected and does not extend outwards.

In the above-mentioned embodiment, the base of the U-profile support can be arranged in the plane of the open sole-side. The closed side of the support contributes then to the formation of the walking-surface of the sole which is interrupted only in the plane of the rollers.

The rollers may be arranged completely in the area of the sole. However, when only the front rollers are arranged within the area of the sole, and the two rear rollers extend laterally somewhat from the sole, i.e., the distance between rollers on each axle is equal, the rollers form a sufficiently broad track.

The instant invention also proposes that two levers are arranged colinearly and are carrying the rollers, whereby said levers are somewhat centrically pivotally positioned and are provided with a cavity at their ends which point towards each other, on one hand, and are provided with a protrusion on the other hand, and whereby said protrusion extends beyond the clearance of the cavity of the opposite lever when the rollers are placed into their recessed position, and when the rollers, while protruding from the sole, extent into the cavity, whereby the protrusion is arranged to be tiltable from the clearance.

Such a roller mechanism is especially simple in its structure and its activation. Instead of a special activating member, the rollers serve as activating means and are engaged in order to bring said rollers into the protruding position and to tilt them into the pulled-back or recessed position.

BRIEF DESCRIPTION OF THE DRAWINGS

The preferred embodiments of the instant invention are illustrated in the drawings, wherein.

DETAILED DESCRIPTION OF PREFERRED EMBODIMENTS

Figure 1:
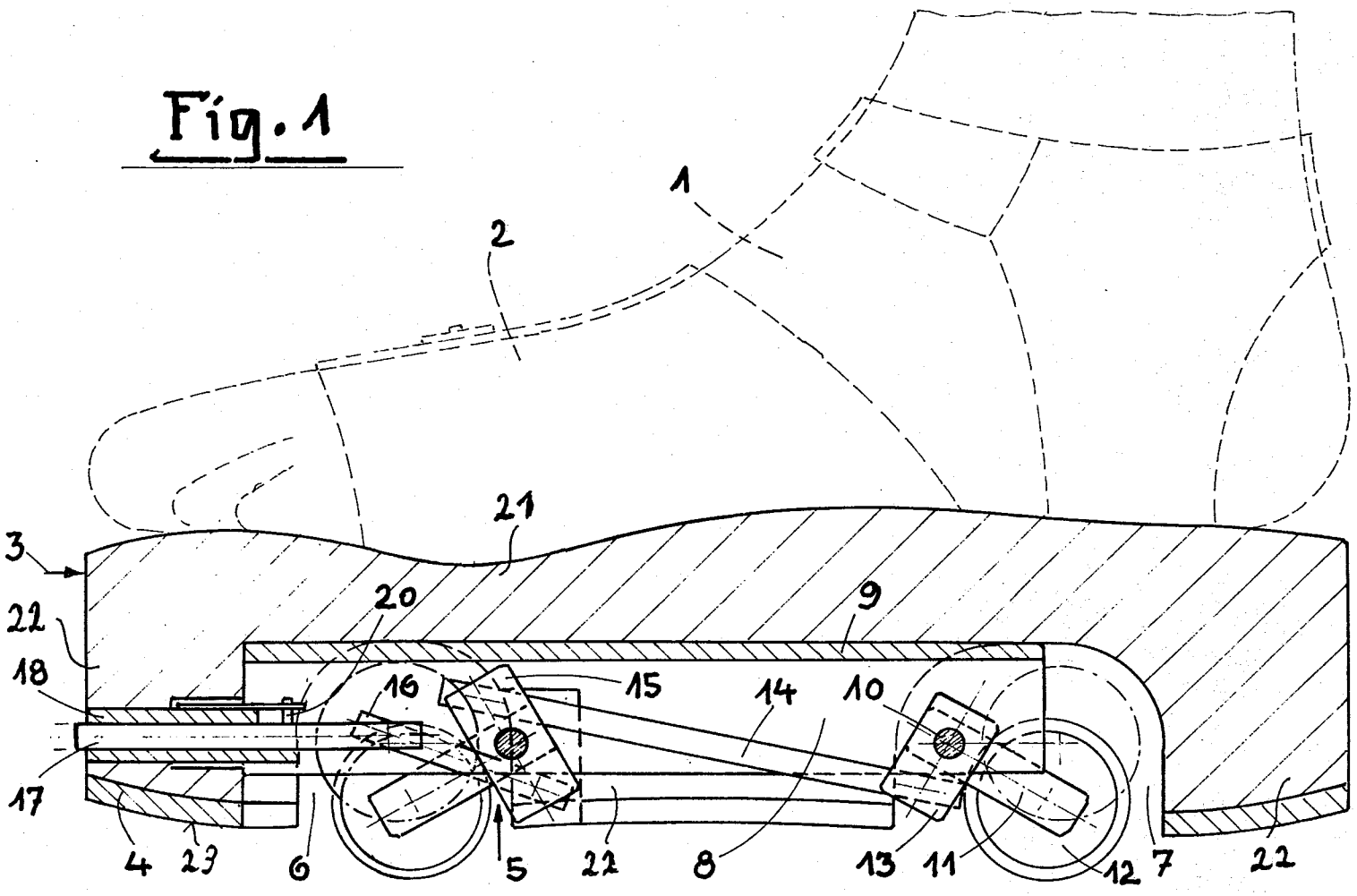
FIG. 1 shows a cross-sectional view of a roller and walking shoe.
Figure 2:
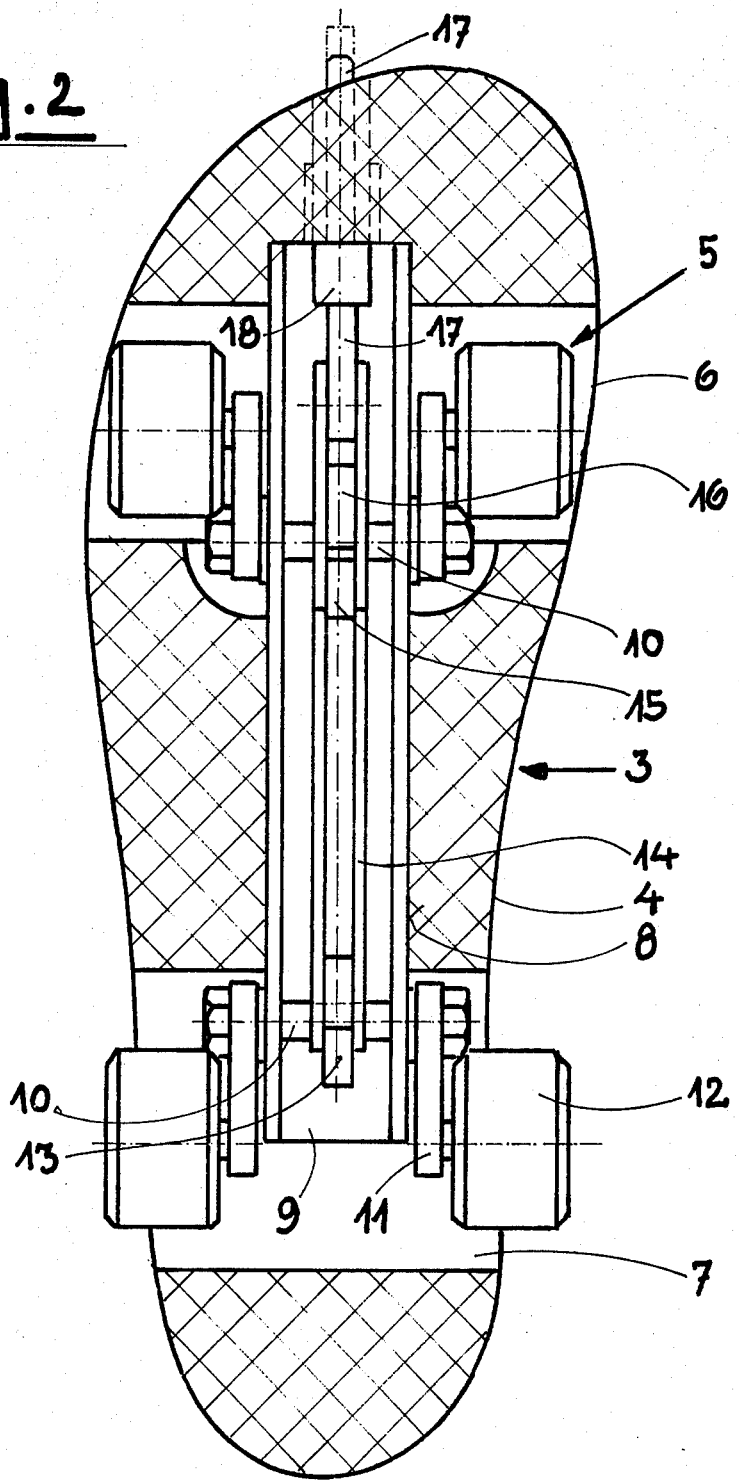
FIG. 2 illustrates the bottom side of the shoe of FIG. 1.

A roller- and walking-shoe is shown in FIGS. 1 and 2, wherein a foot 1 is placed into a shoe's upper portion 2, which is fastened to a sole 3, which forms the entire lower part of the shoe, namely, extending from the toe-to the heel-end of the shoe. The sole 3 has on its bottom portion a walking layer 4 which can be made of rubber. The remainder of the sole can be made of wood or of a synthetic material. The entire sole is extremely thick (platform sole). The sole is provided with a cavity 5, which comprises two transversely over the entire sole-width extending cross-sections 6, 7 and a longitudinal section 8 connecting said cross-sections.

A U-profile support member 9 extends through the longitudinal section 8, into the two cross-sections 6, 7 of the cavity 5. The support member is embedded completely into said cavity 5. One each axle 10 is pushed through the support member 9 at the front and rear section in the area of the cross-sections 6, 7. Each axle carries on its protruding ends one each lever 11 at the end of which is rotatably positioned a roller 12. The front levers 11 extend from the respective axle 10 towards the front of the mechanism, whereby the rear levers extend from their respective axle towards the back of the mechanism.

The rear axle 10 carries in the area of the support member 9 a downwardly-directed lever 13 on which is pivoted a forwardly-directed rod 14 with a double-lever 15 connected thereto. Double-lever 15 is mounted onto the front axle 10 in the area of the support member 9, and has a portion extending downwardly beyond the axle 10 on which portion there is hinged, or pivoted, a short rod 16. This downwardly-pointed rod 16 is pivoted on a rod-shaped activating member 17, which is displacably arranged in the front end section of the sole 3 in a socket 18.

FIG. 1 shows rollers 12 and rods in pulled-out roller-position, which is secured by means of stop member 20 when the activating member 17 is pushed in. The stop 20 is released when the activating member 17 is pushed in and the wheels can now take the position, as shown in the broken line, under the pressure of a spring (not shown). The activating member 17 moves thereby forward, the dual-lever rotates clockwise, the front rollers tilt upwards, the rod 14 moves backwards, the lever 13 rotates counterclockwise and thereby tilts the rear rollers 12 upwards.

The sole 3 has a relatively thin in vertical direction sole area 21 on which the foot 1 rests. Underneath said sole area is securely mounted the entire roller mechanism, including rollers 12, pivotal levers 11, switch mechanism, etc. In front of the rollers, behind the rollers, and between the two roller pairs are provided thicker portions 22 of the sole 3 which form a walking surface 23. With this walking surface 23 the thicker portions 22 extend beyond the rollers 12, when said rollers are pulled back.

Figure 3:
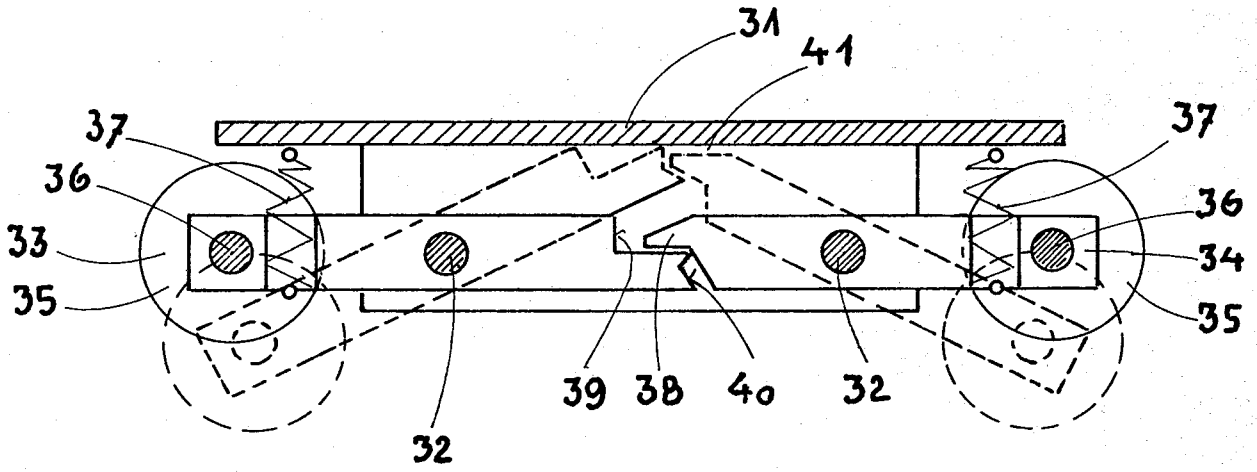
FIG. 3 is a schematic illustration of a further roller-mechanism for a roller- and walking-shoe.

A roller mechanism according to FIG. 3 can be mounted on a sole of FIGS. 1 and 2. A support member 31 carries two axles 32 which are placed a distance apart from each other, and on which are pivotally positioned two levers 33 and 34. The front lever 33 carries on its front section two rollers 35 and the rear lever 34 carries on its rear section two rollers 35, all of which being rotatable on axles 36. In the vicinity of the rollers 35 is a draw-spring 37 which functions between the lever 33 or 34 and the cross-bar of the profile 31. The front lever 33 is provided at its end facing the rear lever 34 with a cavity 40 having arranged thereto a protrusion 38 on that end of the rear lever 34 which is opposite the rollers 35. When the rollers 35 are placed in their pulled-up position as shown in FIG. 3, then the protrusion 38 extends beyond the cavity 40, wherefore the lever 33 is provided with a cavity 39. The the rollers 35 are in a position indicated by the broken line, then the protrusion 38 extends into the cavity 40 and the rear lever 34 which is provided with protrusion 38 has still a distance 41 from the crosscut of the profile 31.

The rollers are placed in the position in which they extend beyond the sole, in the following manner:

Drive-mechanism released:

On each lever 33, 34 are mounted a set of two drive-rollers 35 on an axle 36. By pulling down the front pair of rollers the pivotal lever 33 is pushed upwards over the pivotal axle 32 and thereby forcibly moves the other pivotal lever 34 over its respective pivotal axis 22 upwards. By means of resting the pivotal lever 33 on the inside of the profile 31, the pivotal lever 34 snaps into the slot or clearance 40 of the pivotal lever 33. Pivotal levers 33 and 34 are wedged together by means of the draw springs 39, whereby the rollers are retained in their sole-protruding position.

Drive-mechanism locked:

By pulling down the rear pair of rollers and therewith also the pivotal lever 34, the other pivotal lever 33 snaps out of its wedged position by means of the pull of the draw-spring and is pulled by the spring into the sole-cavity in a horizontal position. Since now the pivotal lever 34 is no longer in contact with the other pivotal lever 33, also this lever tilts on account of the draw-spring back into the sole-cavity in the horizontal position, whereby also the rollers are tilted in a position behind the sole-area.

What is claimed is:

1. A roller- and walking-shoe comprising:

a sole enlarged in thickness defining a cavity; and a roller mechanism mounted in said cavity, said roller mechanism comprising: a plurality of rollers mounted on axles, a mounting means connecting said axles with said sole such that said rollers can selectively extend downwardly below said sole or be retained within said sole, a locking means to hold said mounting means in position when said rollers are extended, and at least one spring connected between said mounting means and said sole to pull and retain said mounting means into said cavity.

2. The roller- and walking-shoe according to claim 1, wherein the mounting means comprises two collinear levers, each approximately centrically pivoted and having said axle affixed at the outermost end; and the locking means comprises the first of said two collinear levers having the end opposite said axle notched and the second of said two collinear levers having at the end opposite said axle a protrusion with the end of said protrusion notched whereby when the mounting means is in a retracted position, said protrusion of said second lever rests in the notch of said first lever and when said mounting means is in an extended position, a protrusion formed by the notch of said first lever fits in the notch on the end of a protrusion of said second lever thereby locking said mounting means extending downwardly below said sole.

3. The roller- and walking-shoe according to claim 2, wherein said roller mechanism is fixedly positioned on a support member which is removable from said cavity.

4. The roller- and walking-shoe according to claim 3, wherein said support member is in the shape of a U in the direction perpendicular to the length of said sole and the open side of the U-faces downwardly.

5. The roller- and walking-shoe according to claim 1, wherein said mounting means comprises a plurality of levers connected such that the action of all axles is forcibly coupled.

6. The roller- and walking-shoe according to claim 1, wherein said roller mechanism is fixedly positioned on a support member which is removable from said cavity.

7. The roller- and walking-shoe according to claim 6, wherein said support member is in the shape of a U in the direction perpendicular to the length of said sole and the open side of the U-faces downwardly.

8. The roller- and walking-shoe according to claim 1, wherein the locking means comprises a step-switch and an activating member.

* * * * *